United States Patent [19]

Simpson

[11] Patent Number: 4,884,603

[45] Date of Patent: Dec. 5, 1989

[54] DEVICE FOR HOLDING THE MOUTH OF A FLEXIBLE BAG OPEN AND METHOD OF USE

[76] Inventor: Ted Simpson, 231 Banbury Rd., Columbia, S.C. 29210

[21] Appl. No.: 349,178

[22] Filed: May 9, 1989

[51] Int. Cl.[4] ..... B65B 39/02; B65B 67/00

[52] U.S. Cl. ..... 141/390; 141/10; 141/114; 141/316; 15/257.1; 248/99; 383/34; 53/390; 294/1.3

[58] Field of Search ..... 141/114.10, 390, 391, 141/315–317; 15/257.1, 257.4, 257.9; 248/95, 99; 383/33, 34, 34.1; 294/1.3; 53/390

[56] References Cited

U.S. PATENT DOCUMENTS

| | | | |
|---|---|---|---|
| 3,822,524 | 7/1974 | Jerpbak | 141/390 |
| 3,934,803 | 1/1976 | Paulus, Jr. | 248/99 |
| 3,936,087 | 2/1976 | Alexander | 248/99 X |
| 3,983,914 | 10/1976 | Benson | 141/390 |
| 4,037,778 | 7/1977 | Boyle | 141/390 |
| 4,457,483 | 7/1984 | Gagné | 141/390 X |
| 4,628,007 | 12/1986 | Ledsham | 141/390 X |
| 4,659,045 | 4/1987 | Flynn | 248/99 |
| 4,749,011 | 6/1988 | Rylander | 141/316 |
| 4,760,982 | 8/1988 | Cooke | 248/99 |

*Primary Examiner*—Ernest G. Cusick
*Attorney, Agent, or Firm*—Rogers & Killeen

[57] ABSTRACT

A device for holding a flexible bag open for filling. The device includes a generally triangular insert that, when folded at two corners, is able to stand upright for facilitating placement of a flexible bag over the upright corner of the triangular insert, and which may thereafter be placed with the flat face down on the ground to facilitate the raking of leaves therein, and one or more reinforcing members on the insert providing a springlike action to the folded corners and keeping the bag open.

15 Claims, 1 Drawing Sheet

DEVICE FOR HOLDING THE MOUTH OF A FLEXIBLE BAG OPEN AND METHOD OF USE

BACKGROUND OF THE INVENTION

The present invention relates to devices for holding open flexible bags so that the bags may be filled.

Keeping a flexible bag open during the initial stages of a bag filling process has long been recognized as a problem. Flexible bags, such as the traditional thin, plastic lawn and household bags, do not have the inherent stiffness to remain open and thus must be held open for filling until the bag is sufficiently full to stand open without support. Without external or internal structural support to hold the bag open, a user must either hold the bag open with one hand while filling with the other, or find an assistant to hold it open.

Various approaches have been advanced to provide structural support for holding a flexible bag open. Flat devices to provide such support must be rolled or folded and inserted into the bag. Positioning the device inside the bag, however, can be as cumbersome as filling the bag. Typically, the bag must be held open with one hand and the device held rolled or folded with the other hand while positioning the device inside the bag. For example, the flat, resiliently deformed sheet disclosed in the Rylander U S. Pat. No. 4,749,011 dated June 7, 1988 must be rolled into a cylinder. The folded device disclosed in the U.S Pat. No. 4,037,778 issued July 26, 1977 to Boyle is also awkward to insert.

In other approaches, the end of the structure first placed inside the bag is generally the same size as the end of the structure holding the bag open, thus offering no shape advantage to the user trying to position the device inside the bag. See, for example, Boyle and Rylander, supra, U.S. Pat. Nos. 4,530,533 issued July 23, 1985 to Dieter, and 3,934,803 issued Jan. 27, 1976 to Paulus, Jr.

Once the device is inside the bag, it is desirable to have the portion of the device holding the bag adjacent the ground remain flat so that the device can be used as a scoop or so that articles can be swept into the bag like a dustpan. Devices such as disclosed by Rylander, supra, are not flat, and devices such as disclosed by Boyle, supra, are designed to be used upright and would collapse if laid flat.

It is also desirable that the device holding the mouth of the bag open not restrict the size or shape of the opening so that oversized or irregularly shaped articles may be inserted. In the devices disclosed in the Dieter and Paulus, Jr. patents, supra, for example, there is a fixed size and shape for the opening.

Manufacturing complexity, ease of transportation, and cost of materials are also of importance in such devices. The device disclosed by Paulus, Jr., supra. for example, includes several wood slats and locking tabs and is relatively complex, difficult to transport once assembled, and expensive.

It is accordingly an object of the present invention to provide a novel device for holding a flexible bag open which obviates many of the problems of known devices and which is easily manufactured from low-cost material and is easy to use.

It is another object of the present invention to provide a novel device for holding a flexible bag open which is able to stand upright without external support so that the device may be easily positioned inside a flexible bag by a single user.

It is yet another object of the present invention to provide a device for holding a flexible bag open that is shaped to facilitate positioning of the device inside the bag, wherein the end of the device first positioned inside the bag is smaller than the end of the device holding open the bag.

It is still another object of the invention to provide a device for holding a flexible bag open that may be placed flat on the ground for easy filling.

It is a further object of the present invention to provide a device for holding a flexible bag open which has resiliently responsive side panels for accommodating bags of varying size and which facilitates changing the shape of the bag opening.

It is yet a further object of the present invention to provide a device for holding a flexible bag open that is lightweight and made of sheet cardboard and a single length of wire.

These and many other objects and advantages will be readily apparent to one skilled in the art to which the invention pertains from a perusal of the claims, the appended drawings, and the following detailed description of preferred embodiments.

DETAILED DESCRIPTION OF PREFERRED EMBODIMENTS

Figure 1:
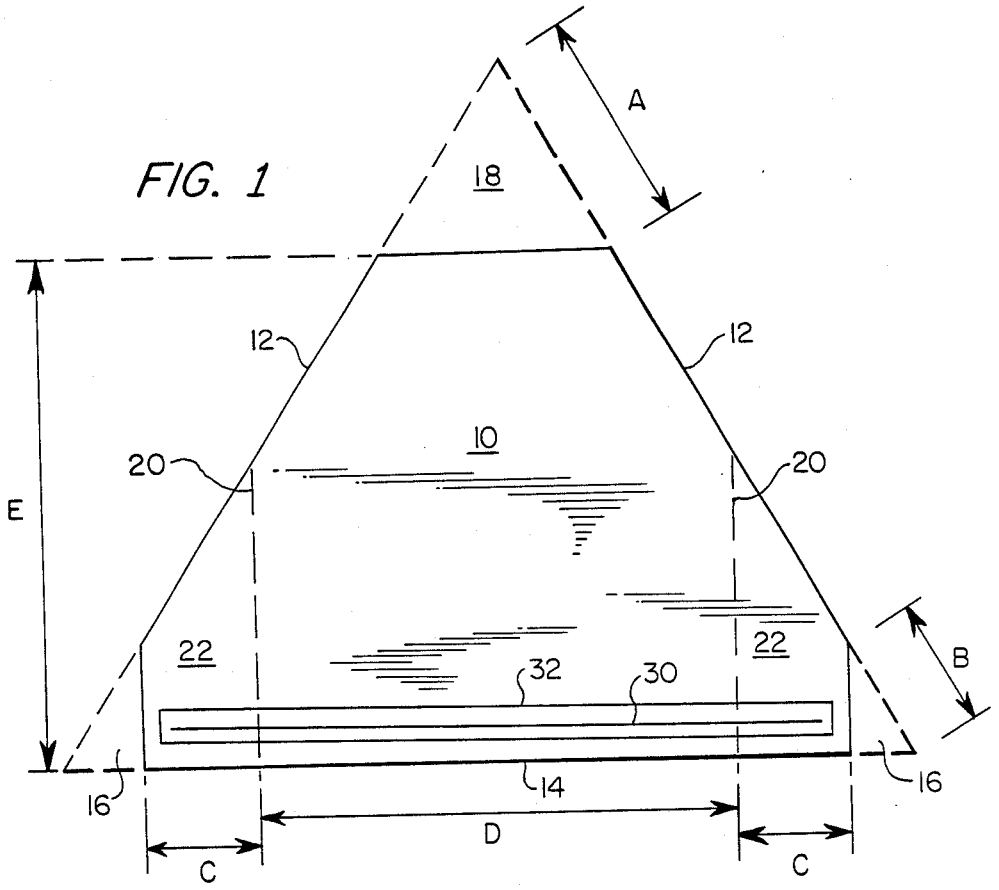
FIG. 1 is a top plan view of an embodiment of the device of the present invention.

With reference to the figures where like elements have been given like numerical designations to facilitate an understanding of the invention, and particularly with reference to the embodiment of the device of the present invention illustrated in FIG. 1, the device may be constructed of a generally triangular planar insert 10 having two crease lines 20 to facilitate folding, and one or more reinforcing members 30.

With further reference to FIG. 1, the planar insert 10 may take the shape of an isosceles triangle having two sides 12 of nearly equal length and a base side 14. The corners of the triangular insert may be truncated, with the corners 16 on the ends of the base side 14 being truncated generally perpendicular to the base side 14, and with the corner 18 opposite the base side 14 being truncated generally parallel to the base side 14. While the amount truncated from each of the corners 16, 18 may vary, it is preferred, for a better fit into a bag, that the amount A (measured lengthwise on a side 12) truncated from corner 18 be approximately twice the amount B truncated from corners 16.

The insert 10 is desirably formed from a rigid sheet material that may be deformed by a user without tools. It is also desirable that the material be able to withstand routine scraping and contact with rough ground for multiple uses. It is further desirable that the insert 10 be lightweight and of low cost. To this end, the insert may be a heavy-duty paper product such as sheet cardboard. While the insert 10 may be treated to repel water, special treatment of the material is not generally necessary.

One face of the insert 10 may be provided with crease lines 20 along which the insert may be folded. These lines may take the form of grooves, perforations, scorings, or other means known in the art to facilitate the folding of a deformably rigid material. The lines 20 may extend generally perpendicular to the base side 14 continuously across the face of the insert 10.

Two side panels 22 are formed when the insert 10 is folded along the lines 20. The side panels 22 should be of sufficient size to be able to hold the insert 10 upright without external assistance, as sen in FIG. 2. When the insert 10 is standing upright, a bag 50 may be positioned on the insert by an unassisted user as indicated by the arrows in FIG. 2.

With reference again to FIG. 1, the size C (measured along the base side 14) of the side panels 22 may vary, with a preferred size being approximately one-quarter the distance D between the lines 20.

The device of the present invention may also include one or more reinforcing members 30 for reinforcing the base side 14 of the insert 10. One reinforcing member 30 is preferably affixed to the face of the insert 10 opposite the face having the lines 20. In addition to or instead of this member, one or more reinforcing members 30 may optionally be affixed to the face having the lines 20, on the edge of the base side 14, or inside the material forming the insert 10. They may be affixed to the insert 10 with tape 32 or other adhesive suitable for the insert material. The members 30 may extend nearly the entire length of the base side 14, but should reach at least beyond both lines 20. The members 30 may be generally parallel to and adjacent the base side 14.

The members 30 may be formed of a resilient material that is bendable by a user without tools such as metallic wire, plastic strip or tubing. The members 30 should have resilience sufficient to resist bending when only slight force is applied so that the center portion of the base side 14 remains flat during use. It is desirable that the members 30 be lightweight and have low cost. To this end, the members 30 may be of the size and resiliency of a standard coat-hanger wire and affixed with any suitable, conventional adhesive such as packaging tape.

Figure 3:
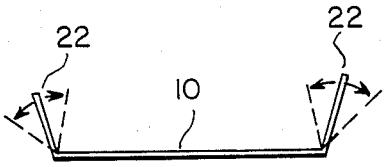
FIG. 3 is an end-on plan view of the base side of the device of FIG. 1 illustrating the springlike action of the side panels of the device.

When the members 30 are affixed to the insert 10 and the panels 22 are foldably formed, the resilience of the members 30 should be able to create a springlike action in the panels 22. The springlike action of the panels 22, as indicated by the arrows in FIG. 3, may be effective over a portion of the range of movement of the panels. With the springlike action in the panels 22, the present invention is able to accommodate bags of varying sizes. Further, the springlike action of the panels 22 allows the opening of a bag 50 to be deformed to receive articles of varying sizes and/or irregular shapes when the insert 10 is in place in the bag.

The dimensions of the insert may be varied to meet the needs of the user. For example, in the embodiment of FIG. 1, it has been found desirable to have the distance D between the lines 20 nearly equal to the distance E between the base side 14 and the opposite truncated corner 18, but such equivalence is not required. For lawn bags, the distances D and E may be unequal and between approximately twenty and thirty-five inches and distance C may be between approximately five and ten inches, with the preferred distances being twenty-five and six inches, respectively. For smaller bags, such as household bags, the distances D and E may be unequal and between approximately five and twenty inches and distance C may be between approximately two and five inches.

Figure 2:
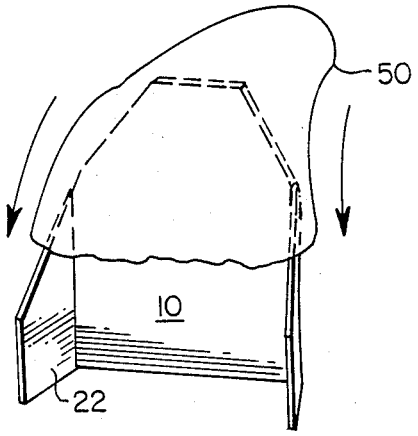
FIG. 2 is a pictorial front view of the device of FIG. 1 folded and placed upright showing the positioning of the device in a flexible bag.

In operation, the device of the present invention may be transported flat, as shown in FIG. 1, with or without members 30 affixed. The user affixes the reinforcing members 30, if required, and folds the insert 10 along the lines 20. The device is placed upright and supported by the panels 22, as shown in FIG. 2. The user places a suitable bag 50 over the narrower upright portion of the device, completely enveloping the insert. Because of the generally triangular shape of the insert 10 and the device's ability to stand upright, this operation is easily accomplished by a single user without assistance.

Figure 4:
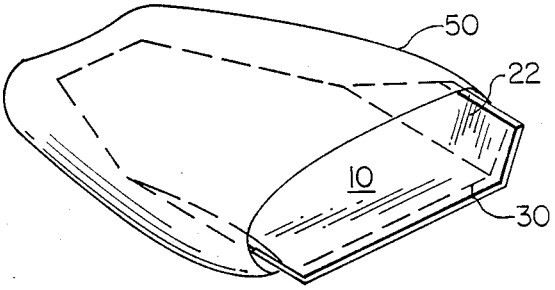
FIG. 4 is a pictorial partial side view of the device of FIG. 1 illustrating the device inside a bag on the ground ready for filling.

Once the bag 50 is in place over the insert 10, the bag and insert may be placed on the ground with the free ends of the panels 22 pointing upward, as seen in FIG. 4. The flat center portion of the insert 10 adjacent the ground forms a flat shovel-like section for filling the bag by scooping. The panels 22 may exert slight pressure on the bag opening, holding it open. For large or irregularly shapes articles, the panels 22 flex with springlike action to allow the opening of the bag to be deformed as required.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

I claim:

1. A device for holding a flexible bag in an open position for filling, comprising:

(a) a deformably rigid planar insert capable of being folded and inserted into a flexible bag, said insert generally having the shape, when flat, of an isosceles triangle with three truncated corners, the first two corners at the distal ends of the base side of said triangular insert being truncated generally perpendicular to said base side, and the third corner opposite said base side being truncated generally parallel to said base side, said triangular insert having on a first face thereof two linear spaced apart crease lines generally perpendicular to said base side extending across said first face for forming panels between said crease lines and said first two corners and for facilitating the folding together of said panels to form a U-shape, wherein the distance between said two crease lines is approximately equal to the perpendicular distance between said base side and said truncated third corner; and (b) a generally linear, bendably rigid, reinforcing member affixed to the second face of said insert opposite said first face extending beyond said crease lines, said member being adjacent and generally parallel to said base side for selectively maintaining said insert in a flattened or a folded form, said member being resilient for creating a springlike action in said panels when said insert is folded along said crease lines, whereby said insert, when folded along said crease lines into a generally U-shape, may be positioned inside a flexible bag, said third corner first, with said springlike action of said panels resiliently exerting pressure upon the bag to hold the bag open for filling, and whereby said insert, when folded along said crease lines, is able to stand upright on said base side supported by said panels to facilitate the placement of a flexible bag over said third corner and onto said insert, and whereby said insert, when folded and positioned inside a flexible bag, holds a portion of the opening of the bag flat for filling and simultaneously allows another portion of the opening of the bag to be resiliently deformed for filling oversized and/or irregularly shaped articles.

2. The device as defined in claim 1 wherein said insert further comprises a heavy-duty paper product and wherein said member comprises a metallic wire affixed to said second face with adhesive tape.

3. The device as defined in claim 1 wherein the amount truncated from said third corner, as measured along one of the two equal length sides of said triangular isert, is approximately twice the amount truncated form each of said first two corners.

4. The device as defined in claim 1 wherein the distance between said crease lines is approximately four times the width of one of said panels as measured along said base side.

5. The device as defined in claim 1 wherein said member comprises a plastic strip.

6. A device for holding the mouth of a flexible bag open, comprising:

(a) a rigid planar insert capable of being folded, said insert being generally shaped like a triangle with three truncated corners, the first two corners at the distal ends of the base side of said triangular insert being truncated generally perpendicular to said base side, and the third corner opposite said base side being truncated generally parallel to said base side, said triangular insert having on a face thereof two spaced apart fold lines generally perpendicular to said base side extending across said face for forming panels and for facilitating the folding together of said panels; and (b) one or more reinforcing members affixed to said insert, said one or more members being adjacent to said base side for selectively maintaining said insert in a flattened or a folded form, said one or more members being resilient for creating a springlike action in said panels when said insert is folded along said fold lines, whereby said insert, when folded along said fold lines, may be inserted into a flexible bag with said panels holding the mouth of the bag open, whereby said insert, when folded along said fold lines, is able to stand upright on said base side supported by said panels, and whereby said insert, when folded and positioned inside a flexible bag, holds a portion of the mouth of the bag flat and allows another portion of the mouth of the bag to be resiliently deformed.

7. The device as defined in claim 6 wherein said triangular insert has two sides of nearly equal length, neither of said two sides being said base side.

8. The device as defined in claim 6 wherein said insert further comprises a cardboard paper product.

9. The device as defined in claim 8 wherein one of said one or more members is affixed inside said insert.

10. The device as defined in claim 6 wherein said one or more members are affixed to a face of said insert with an adhesive tape.

11. The device as defined in claim 6 wherein said one or more members comprise metallic wire.

12. The device as defined in claim 6 wherein said one or more members comprise plastic strips.

13. A method for holding the mouth of a flexible bag open for filling comprising the steps of:

(a) providing a planar, generally triangular, insert having a base side and two other sides of nearly equal length;

(b) truncating the two corners of the base side of the insert generally perpendicular to the base side;

(c) truncating the third corner opposite the base side generally parallel to the base side;

(d) providing two spaced apart fold lines on a face of said insert generally perpendicular to the base side;

(e) affixing a reinforcing member to said insert generally parallel to and adjacent the base side, said member extending beyond said fold lines;

(f) folding said insert along said fold lines forming a U-shape with panels at the free ends of the U-shape having springlike action;

(g) positioning said insert vertically with the base side down, whereby said insert stands erect supported by said panels;

(h) positioning a flexible bag over said third corner, enveloping said insert; and (i) positioning said enveloped insert horizontal with said panels pointing up, whereby the mouth of the bag is held open for filling.

14. The method as defined in claim 13 wherein said insert comprises a cardboard paper product.

15. The method as defined in claim 14 wherein said reinforcing member comprises a metallic wire that is affixed to said insert with an adhesive tape.

* * * * *